US007478495B1

(12) United States Patent
Alzamora et al.

(10) Patent No.: US 7,478,495 B1
(45) Date of Patent: Jan. 20, 2009

(54) MECHANICAL BUFFER FOR SHOULDERED WEAPON

(75) Inventors: Ronny Alzamora, Belleville, NJ (US); John Heinsohn, Budd Lake, NJ (US); Brian Donovan, Stroudsburg, PA (US); Kevin Russell, Jersey City, NJ (US); Adam Foltz, Somerset, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 57 days.

(21) Appl. No.: 11/612,025

(22) Filed: Dec. 18, 2006

(51) Int. Cl.
*F41C 23/06* (2006.01)
*F41A 25/12* (2006.01)
*F41A 3/78* (2006.01)

(52) U.S. Cl. ..... 42/74; 89/44.01; 89/44.02; 89/198

(58) Field of Classification Search ..... 42/74; 89/44.01, 44.02, 198
See application file for complete search history.

(56) References Cited

U.S. PATENT DOCUMENTS 3,977,296 A * 8/1976 Silsby et al. ..... 89/198
4,057,003 A * 11/1977 Atchisson ..... 89/138
4,667,566 A * 5/1987 Bosshard et al. ..... 89/44.01
5,031,348 A * 7/1991 Carey ..... 42/74
5,710,389 A * 1/1998 Canaday ..... 89/194
5,726,377 A * 3/1998 Harris et al. ..... 89/191.01
5,827,992 A * 10/1998 Harris et al. ..... 89/191.01
5,909,002 A * 6/1999 Atchisson ..... 89/130
6,418,833 B1 * 7/2002 Hajjar ..... 89/199
6,829,974 B1 * 12/2004 Gwinn, Jr. ..... 89/130
6,848,351 B1 * 2/2005 Davies ..... 89/191.01
7,131,367 B1 * 11/2006 Boerschig et al. ..... 89/198
7,213,498 B1 * 5/2007 Davies ..... 89/198
2006/0048637 A1 * 3/2006 Dimitrios ..... 89/14.3
2006/0236853 A1 * 10/2006 Boersching et al. ..... 89/198

* cited by examiner

*Primary Examiner*—Michael Carone
*Assistant Examiner*—Michael D David
(74) *Attorney, Agent, or Firm*—John F. Moran

(57) ABSTRACT

A weapon includes a receiver having a bolt carrier assembly therein; a buttstock disposed behind the receiver, the buttstock having a tubular opening adjacent an end of the bolt carrier assembly; a larger diameter spring disposed in the tubular opening; a smaller diameter spring disposed in the larger diameter spring; a rod disposed in the rear end of the smaller diameter spring; a bumper attached to the rod; and a cap disposed in the front end of the spring, the cap having a head wherein a front side of the head engages the end of the bolt carrier assembly and a front end of the larger diameter spring bears against a rear side of the head.

7 Claims, 5 Drawing Sheets

MECHANICAL BUFFER FOR SHOULDERED WEAPON

STATEMENT OF GOVERNMENT INTEREST

The inventions described herein may be manufactured, used and licensed by or for the U.S. Government for U.S. Government purposes.

BACKGROUND OF THE INVENTION

The invention relates in general to munitions and in particular to shouldered firearms.

The M4 Carbine is a family of firearms tracing its lineage back to earlier carbine versions of the M16. The M4 is a shorter and lighter version of the M16. The M4 is gas-operated, air-cooled and magazine-fed. The M4 has selective fire options including full automatic and semi-automatic.

One primary difference between the M4 Carbine and M16 weapon systems is the increased velocity of the M4 bolt carrier. For the M4 Carbine, the higher bolt opening and closing velocities translate to higher cyclic rate and bolt durability problems due to high stress on bolt lugs. Additionally, instances of misfires are increased due to "bolt bounce". Bolt bounce refers to the bolt carrier hitting the barrel with enough velocity so that the bolt carrier rebounds into the path of the hammer. Also, the elevated cyclic rate of the M4 Carbine contributes to feeding problems because the ammunition does not have enough time to properly position itself into the correct location before the bolt carrier interfaces with the round. There is a need to eliminate these problems.

SUMMARY OF THE INVENTION

It is an object of the invention to provide a supplementary mechanical buffer for a firearm.

It is another object of the invention to provide a supplementary mechanical buffer for an M4 Carbine so that operation of the M4 more closely resembles operation of the M16.

One aspect of the invention is a weapon comprising a receiver having a bolt carrier assembly therein; a buttstock disposed behind the receiver, the buttstock having a tubular opening adjacent an end of the bolt carrier assembly; a larger diameter spring disposed in the tubular opening; a smaller diameter spring disposed in the larger diameter spring; a rod disposed in the rear end of the smaller diameter spring; a bumper attached to the rod; and a cap disposed in the front end of the spring, the cap having a head wherein a front side of the head engages the end of the bolt carrier assembly and a front end of the larger diameter spring bears against a rear side of the head.

Another aspect of the invention is a supplementary buffer assembly for a buffer spring, comprising a second buffer spring disposed in the buffer spring; a rod disposed in the rear end of the second buffer spring; a bumper attached to the rod; and a cap disposed in the front end of the spring, the cap having a head wherein a front end of the buffer spring bears against a rear side of the head.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

One purpose of the invention is to mitigate the differences between the M16 and M4 Carbine weapon systems. However, the invention may be used with any compatible weapon that needs a mechanical buffer. The inventive mechanical buffer works in conjunction with the existing buffer spring in, for example, an M4 Carbine. The invention includes a supplemental buffer assembly. The supplemental buffer assembly helps to absorb the energy of the bolt carrier. In the context of the M4 Carbine, the supplemental buffer assembly absorbs the energy of the bolt carrier so that the resulting velocities and displacements of the bolt carrier will mimic the M16.

By manipulating the weight on the springs, the spring materials, the number of coils per inch, the spring coil diameters, and the spring diameters, the desired energy absorption may be achieved. Additionally, altering any or all of these variables allows for quick replacement units, whose desired effect can evolve with user's needs. By having the ability to modify individual components, the invention offers many solutions for the user, affecting configuration management now and in the future.

Figure 1:
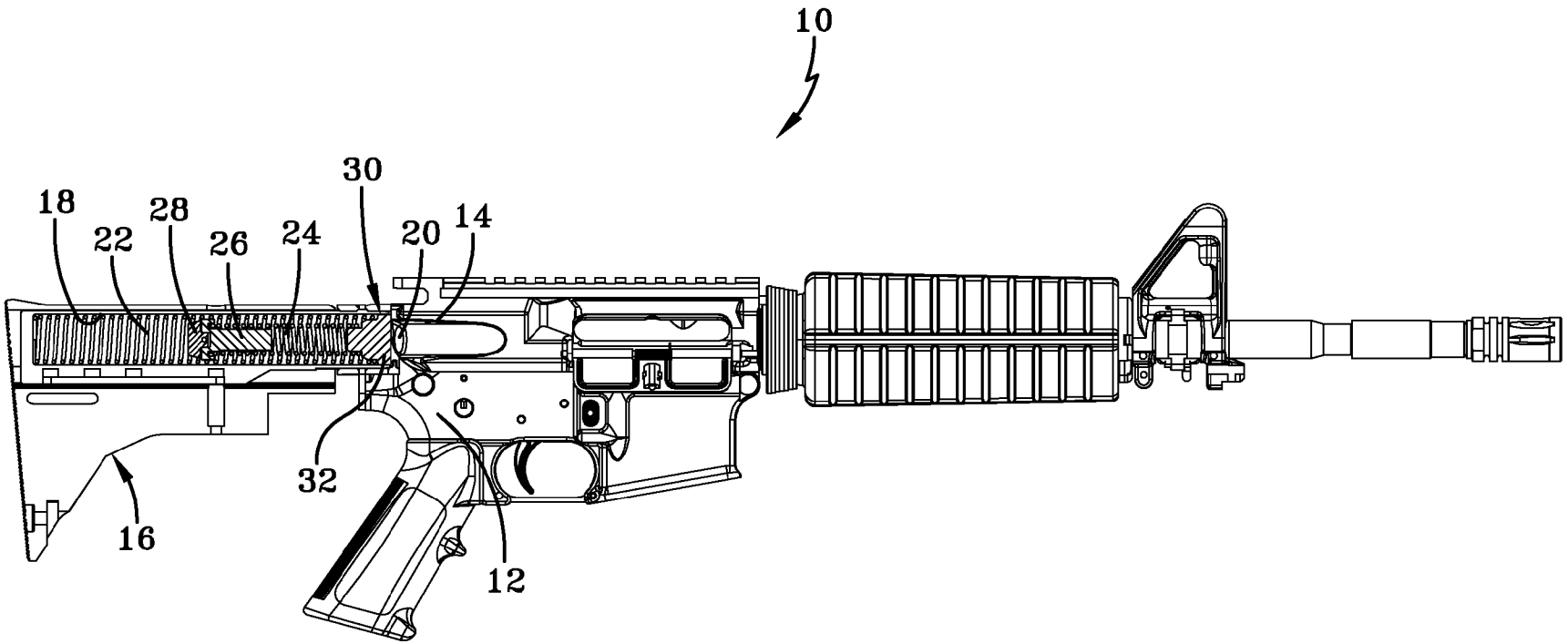
FIG. 1 is a side view, partially cut away, of a weapon.

FIG. 1 is a side view, partially cut away, of a weapon 10. The weapon 10 shown in FIG. 1 is an M4 Carbine, although the invention is not limited to an M4 Carbine. Weapon 10 comprises a receiver 12 having a bolt carrier assembly 14 therein. A buttstock 16 is disposed behind the receiver 12. The buttstock 16 has a tubular opening 18 that is adjacent an end 20 of the bolt carrier assembly 14. Spring 22 is disposed in the tubular opening 18. Spring 22 functions as a buffer. However, to supplement spring 22, a supplementary buffer assembly is needed.

Figure 2:
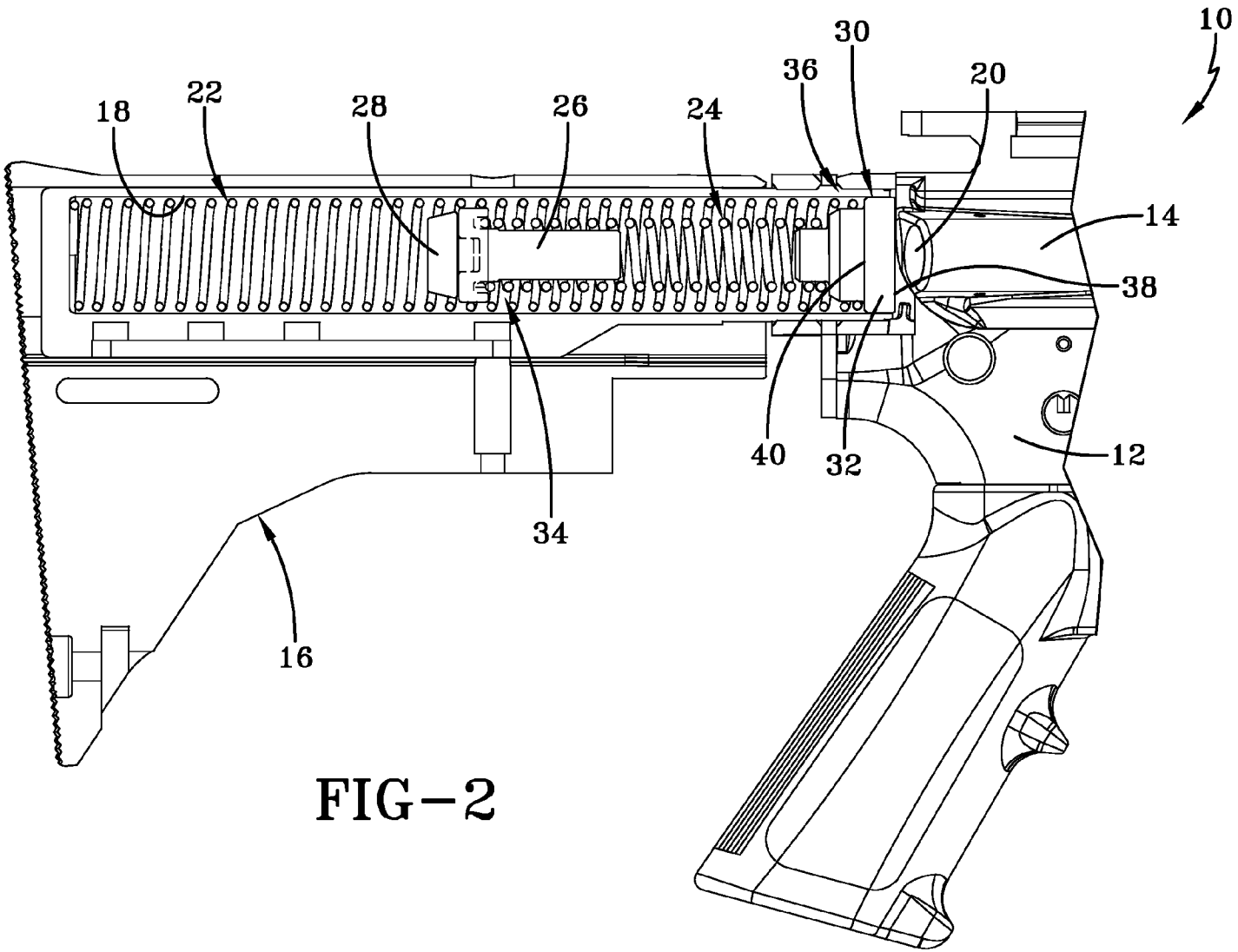
FIG. 2 is an enlarged, side view of the buttstock portion of FIG. 1.

FIG. 2 is an enlarged view of the rear portion of the weapon 10 of FIG. 1. The supplementary buffer assembly comprises spring 24 disposed inside the spring 22. Spring 24 has a smaller diameter than spring 22. A weighted rod 26 is disposed in the rear end 34 of the smaller diameter spring 24. A bumper 28, preferably comprising a polymer, is attached to the rod 26. A cap 30 is disposed in the front end 36 of the spring 22. The cap 30 has a head 32 wherein a front side 38 of the head 32 engages the end 20 of the bolt carrier assembly 14 and a front end 36 of the larger diameter spring 22 bears against a rear side 40 of the head 32.

Figure 3:
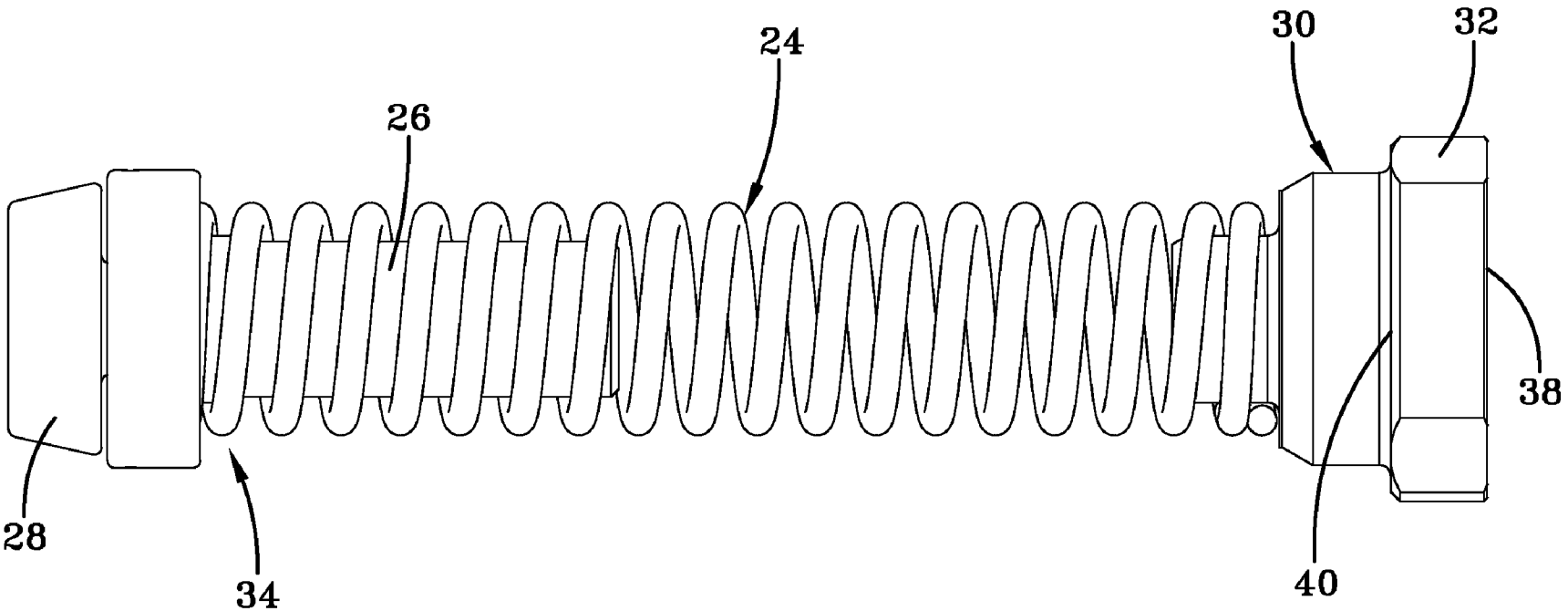
FIG. 3 is an enlarged, side view of a supplementary buffer assembly.
Figure 4C:
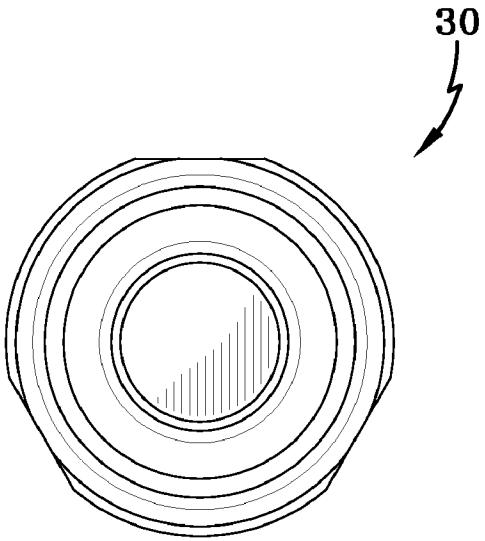
FIGS. 4A-C are end, side and end views, respectively, of a cap.
Figure 4B:
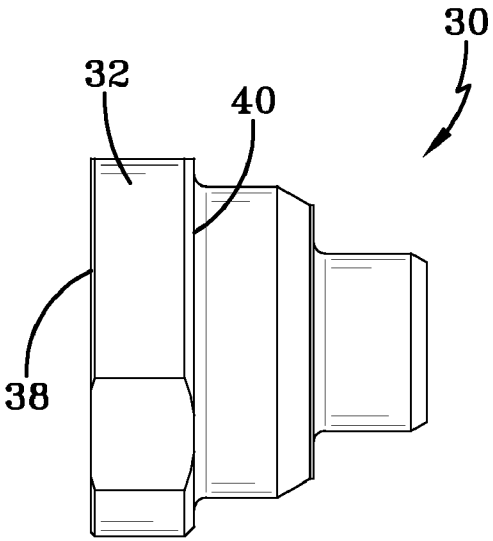
Figure 4A:
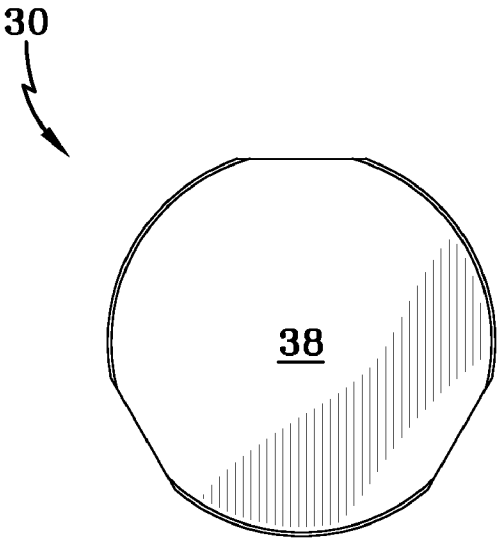
Figure 5B:
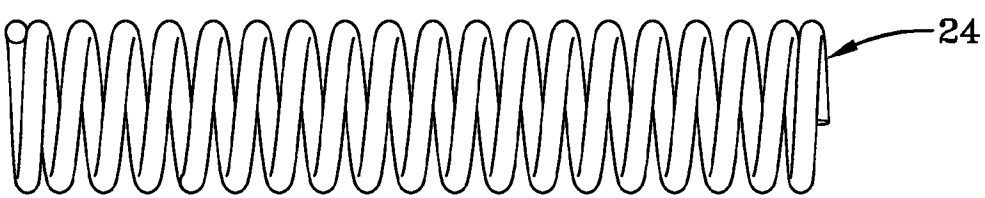
FIGS. 5A-B are end and top views of a spring.
Figure 5A:
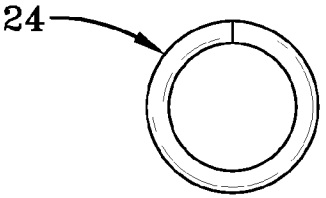
Figure 6C:
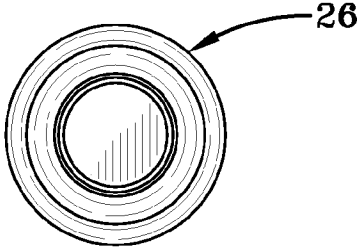
FIGS. 6A-C are end, side and end views, respectively, of a rod.
Figure 6B:
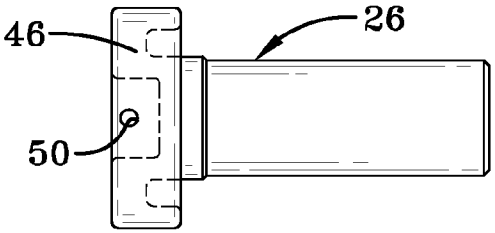
Figure 6A:
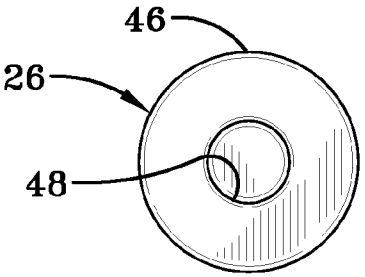
Figure 7B:
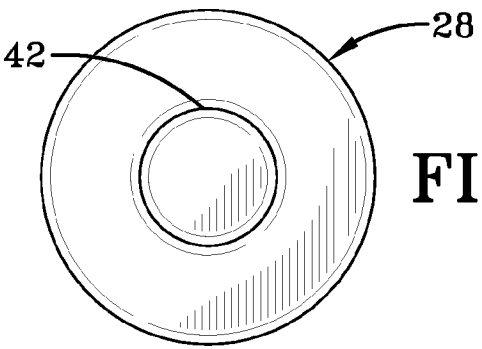
FIGS. 7A-B are side and end views, respectively of a bumper.
Figure 7A:
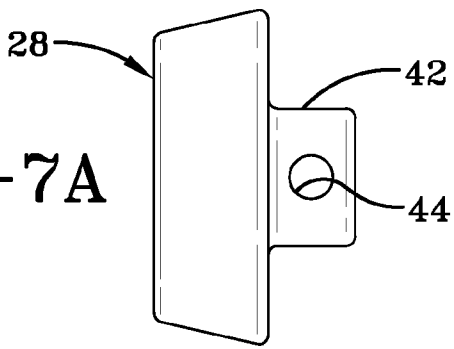

FIG. 3 is an enlarged, side view of the supplementary buffer assembly showing the smaller diameter spring 24, the weighted rod 26, the bumper 28 and the cap 30. FIGS. 4A-C are end, side and end views, respectively, of cap 30. Cap 30 includes head 32 having a front side 38 that engages the end 20 of the bolt carrier assembly 14 and a rear side 40 that engages the front end 36 of the larger diameter spring 22. FIGS. 5A-B are end and top views of spring 24. FIGS. 6A-C are end, side and end views, respectively, of rod 26. Rod 26 is typically solid, except for opening 48 in its head 46. FIGS. 7A-B are side and end views, respectively of bumper 28. Bumper 28 includes a projecting portion 42 with a radial opening 44 therein. Bumper 28 is attached to rod 26 (FIGS. 6A-C) by inserting projecting portion 42 into opening 48 in the head 46 of rod 26. A pin (not shown) is inserted through opening 50 in rod 26 and opening 44 in bumper 28.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A weapon, comprising:

a receiver having a bolt carrier assembly therein;

a buttstock disposed behind the receiver, the buttstock having a tubular opening adjacent an end of the bolt carrier assembly;

a larger diameter spring disposed in the tubular opening;

a smaller diameter spring disposed in the larger diameter spring;

a rod disposed in the rear end of the smaller diameter spring;

a bumper attached to the rod; and a cap disposed in the front end of the springs, the cap having a head wherein a front side of the head engages the end of the bolt carrier assembly and a front end of the larger diameter spring bears against a rear side of the head, the rod not extending into the cap.

2. The weapon of claim 1 wherein the bumper comprises a polymer.

3. The weapon of claim 1 wherein the weapon is an M4 Carbine.

4. The weapon of claim 1 wherein the rod is solid.

5. In a weapon having a receiver with a bolt carrier assembly therein; a buttstock disposed behind the receiver, the buttstock having a tubular opening adjacent an end of the bolt carrier assembly; and a buffer spring disposed in the tubular opening, a supplemental buffer assembly, comprising:

a second buffer spring disposed in the buffer spring;

a rod disposed in the rear end of the second buffer spring;

a bumper attached to the rod; and a cap disposed in the front end of the springs, the cap having a head wherein a front side of the head engages the end of the bolt carrier assembly and a front end of the buffer spring bears against a rear side of the head, the rod not extending into the cap.

6. The buffer assembly of claim 5 wherein the bumper comprises a polymer.

7. The buffer assembly of claim 5 wherein the rod is solid.

* * * * *